US006627256B1

(12) United States Patent
Tanaka et al.

(10) Patent No.: US 6,627,256 B1
(45) Date of Patent: Sep. 30, 2003

(54) METHOD FOR SLAG COATING OF CONVERTER WALL

(75) Inventors: Yoshiyuki Tanaka, Okayama (JP); Nobukazu Kitagawa, Tokyo (JP); Haruji Okuda, Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/411,179

(22) Filed: Oct. 1, 1999

(30) Foreign Application Priority Data

Oct. 5, 1998 (JP) ..... 10-282791

(51) Int. Cl.[7] ..... B05D 1/02

(52) U.S. Cl. ..... 427/142; 427/140; 427/230; 427/236; 427/239; 427/422; 427/427

(58) Field of Search ..... 427/230, 239, 427/236, 140, 142, 421, 427, 422

(56) References Cited

U.S. PATENT DOCUMENTS 4,373,949 A 2/1983 Spruell et al. ..... 75/60
5,567,222 A * 10/1996 Takahashi et al. ..... 75/376

FOREIGN PATENT DOCUMENTS

GB 2157713 A * 10/1985
JP 61-056223 A * 3/1986
JP 62-007814 A * 1/1987
JP 01-004412 A * 1/1989
JP 07-041815 A * 2/1995
JP 08-246018 A * 9/1996
JP 10-183219 A * 7/1998
JP 2000-178631 A * 6/2000
RU 2047660 C1 * 11/1995

OTHER PUBLICATIONS

Goodson, K.M. et al., *Furance Refractory Maintenance and Slag Splashing*, ISS 78th Steelmaking Conference, pp 31–34, Apr. 1995.

Russell, R.O. et al., *Everlasting BOF Linings at LTV Steel?*, LTV Steel Company, pp 220–225 (No date).

Russell, R.O. et al., *Continuous Improvement in BOF Lining Life at LTV Steel*, LTV Steel Company, pp 265–280 (No date).

* cited by examiner

*Primary Examiner*—Shrive P. Beck
*Assistant Examiner*—Kirsten Crockford Jolley
(74) *Attorney, Agent, or Firm*—Piper Rudnick LLP

(57) ABSTRACT

Slag coating is accomplished by blowing a gas from a top-blown lance such that slag is splashed uniformly onto the barrel and throat near the trunnion of the converter; the lance height is adjusted to 0.7–3.0 m and the gas flow rate is adjusted to 250–600 $Nm^3$/min and, after gas blowing, the remaining molten slag is incorporated with a slag solidifier containing MgO or CaO and the molten slag is splashed toward the desired part of the converter wall that needs repair.

11 Claims, 6 Drawing Sheets

BLOWING OF GAS ($N_2$ + Ar) FROM THE MAIN LANCE

ADDITION OF SOLIDIFIER (DOLOMITE)

COATING

4 - 5 MINUTES

METHOD FOR SLAG COATING OF CONVERTER WALL

BACKGROUND OF THE INVENTION

1. Field of the Invention

The present invention relates to a method for slag coating of a converter wall, being intended to extend the life of the converter. The present invention relates also to a method for controlling the thickness of the converter bottom, which tends to increase as a result of repeated slag coating onto the converter wall.

According to the present invention, slag coating is accomplished by blowing out a gas from a top-blown lance so that slag is splashed uniformly onto the barrel and throat near the trunnion of the converter. Slag coating in this way makes it possible to repair the bottom and wall, unlike conventional slag coating which is carried out by tilting the converter.

2. Description of the Related Art

Among conventional methods for repairing the bottom and wall of converters is slag coating. It is designed to utilize slag (resulting from refining) for protection of the bottom and wall refractories of the converter, ready for the next run. It can be applied to both top-blown converters and top-bottom-blown converters, and it is generally used as a convenient rapid repair method. (See Japanese Patent Laid-open No. 37120/1978.)

To apply this repair method, the converter is tilted to discharge refined steel and slag in such a way that at least part of molten slag remains, in the converter. Then, the remaining slag is combined with dolomite (as a solidifier) and the converter is swung around the trunnion axis such that slag sticks to the bottom and wall refractories of the converter. The slag solidifier increases the melting point of slag and decreases the flowability of slag, thereby making the slag stick easily. The disadvantage of this method is that the slag does not stick sufficiently to the area below the position near the trunnion (referred to as the trunnion a side hereinafter) which remains a dead zone when the converter is swung. Hence protection of refractory by the slag is not accomplished.

To address this problem, a new method of slag coating was proposed in Japanese Patent Laid-open No. 16111/1982. This method consists of blowing an inert gas through the bottom-blown nozzle such that the remaining slag in the converter is blown up by the inert gas and caused to stick to the wall refractories. (This method is applicable to both bottom-blown converters and top-bottom-blown converters.) In this way it is possible to apply slag to the bottom and wall below the trunnion side. The disadvantage of this method is the difficulty in splashing slag in desired directions and in distributing slag uniformly on the wall refractories despite the blowing of inert gas at a controlled flow rate.

The present inventors proposed in Japanese Patent Laid-open No. 41815/1995 a method of slag coating which involves the blowing of inert gas through a top-blown lance (in place of bottom-blown nozzles) in top-blown converters and top-bottom-blown converters. This method permits slag coating on the trunnion side, particularly the knuckle part (the boundary between the bottom and the wall) and the bottom, which are difficult to repair by a conventional method. According to this method, an inert gas is blown such that slag is moved to the wall and caused to crawl up along the wall. Slag coating in this way is limited in coating area and is poor in uniformity of coating on refractories. Another disadvantage is incomplete slag coating on the barrel near the trunnion side, and difficulty in coating up to the throat. Therefore, slag coating in this way is not an adequate method of repairing converters.

As mentioned above, Japanese Patent Laid-open No. 37120/1978 discloses a method of slag coating by causing part of molten slag to remain in the converter, adding a solidifier to it, swinging the converter around the trunnion axis, and causing slag to stick to the bottom and wall refractories. The disadvantage of this method is incapability to repair the trunnion side.

Japanese Patent Laid-open No. 16111/1982 discloses a method of slag coating by splashing upward residual slag in the converter with an inert gas blown through the bottom nozzles, thereby causing slag to stick to the wall refractories. The disadvantage of this method is difficulty in splashing slag in desired directions.

Japanese Patent Laid-open No. 41815/1992 discloses a method of slag coating by adding a solidifier to remaining slag, blowing an inert gas through a top-blown lance so as to move slag toward the wall, thereby causing slag to stick to the wall refractories. The disadvantage of this method is the limited coating area, the lack of uniformity in coating, and the difficulty in controlling the slag properties by controlling the lance height and gas flow rate, and also by the addition of a solidifier.

SUMMARY OF THE INVENTION

The present invention was completed to address the above-mentioned problems involved in the prior art technologies.

It is an object of the present invention to provide a new method for slag coating on the converter wall to extend the life of the converter.

According to this method, slag coating is accomplished by blowing a gas from a top-blown lance in a special way toward slag remaining in the converter after tapping in such a way that slag is splashed and stuck to the converter wall. During this slag coating, slag properties are well controlled by adding a slag solidifier and splashing slag is controlled by adjusting the lance height and the gas flow rate, so that the blown slag uniformly and stably sticks to the converter wall, including the barrel, trunnion side, and throat which could not otherwise be repaired by conventional slag coating by tilting the converter.

It is another object of the present invention to provide a method for limiting and controlling the thickness of the converter bottom which would otherwise increase due to accumulation of solidified slag after repeated slag coating onto the converter wall. The method of this invention permits detection of any such increase.

We have carried out extensive studies to find a solution to the above-mentioned problems, by studying the conventional method of slag coating, which consists of causing molten slag to remain on the bottom of the converter after tapping and blowing a gas from a top-blown lance, such that the molten slag is splashed and stuck to the converter wall. As the result, we found that uniform slag coating over the entire surface of the converter wall can be achieved if the lance height (from the bottom) and the gas flow rate are critically adjusted so that the slag is splashed to the desired part of the furnace that needs repair and, immediately after or a certain period after the start of inert gas blowing, the slag is combined with a slag solidifier containing MgO or CaO which forms solid slag in a critical ratio, combined with adjusting the splash height and stickiness of the slag.

In accordance with this invention, the molten slag is caused to remain on the bottom of the converter after tapping and blowing a gas from a top-blown lance, thereby splashing the molten slag and sticking the molten slag to the converter wall, characterized in that the lance height measured from the bottom is adjusted to about 0.7–3.0 m and the gas flow rate is adjusted to about 250–600 $Nm^3$/min and, after gas blowing, the remaining molten slag is combined with a slag solidifier containing MgO or CaO according to its composition, and top blowing in the presence of the slag solidifer so that the height of slag splashing is controlled in the presence of the slag solidifier and the amount of slag sticking to the converter wall is controlled and the molten slag solidifier mixture is splashed toward the desired part of the converter wall that needs repair.

An important feature of this invention resides in the lance height from the bottom being adjusted to about 1.0–3.0 m and the gas flow rate adjusted to about 250–600 $Nm^3$/min and, after gas blowing, the remaining molten slag is combined with a slag solidifier containing MgO or CaO according to its composition in an amount enough for the ratio of solid phase in the slag to reach about 0.50–0.70.

In a preferred embodiment, the slag solidifier is added to the remaining slag about 0–2 minutes after the start of gas blowing.

In another preferred embodiment, the slag solidifier is added in combination with all reducing agent so that the ratio of solid phase in the slag is increased to about 0.50–0.70 in the case where the oxygen potential in slag is higher than about 22% in terms of T.Fe.

T.Fe=Total iron content in slag (%), which means metallic iron and iron as oxide(FeO, Fe2O3, Fe3O4, etc all the type).

The gas used for slag splashing may be an inert gas such as nitrogen, argon, or a mixture thereof, or air or a mixture containing air.

The gas flow rate may be reduced to about 250 $Nm^3$/min if the part to be repaired is lower than about 3 meters from the bottom of the converter. The gas flow rate may be increased to about 600 $Nm^3$/min if the part to be repaired is higher than about 7 meters from the bottom of the converter. In other words, the gas flow rate may be adjusted to save utility cost according to the position of the part to be repaired.

It is advantageous to control the bottom thickness of the converter by detecting the back pressure of the gas being forced into the converter through a bottom-blown tuyere and to sense or measure the increase of the bottom thickness of the converter based on the increase of the back pressure at the bottom-blown tuyere.

It is also beneficial to control the bottom thickness of the converter whose wall is coated with slag, by adding an alumina source to the molten slag remaining at the bottom of the converter after tapping, thereby decreasing the melting point of the slag, and stirring the slag with a gas introduced through a bottom-blown tuyere and/or a top-blown lance.

The foregoing and other important features of the invention are shown in specific drawings that serve as examples, but are not intended to define or to limit the scope of the invention.

DESCRIPTION OF THE PREFERRED EMBODIMENTS

Figure 1:
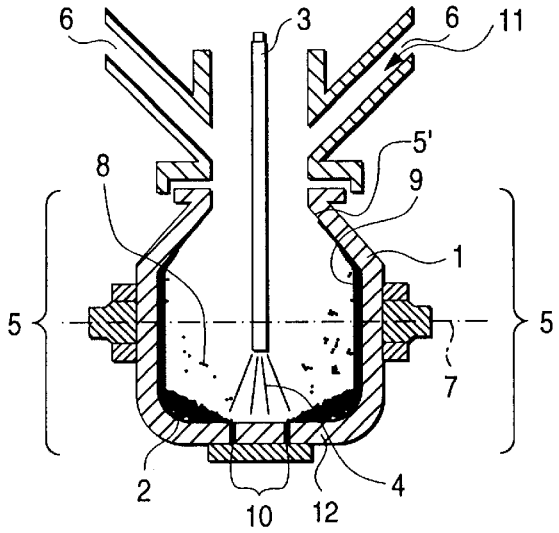
FIG. 1 is a schematic diagram illustrating one embodiment of slag coating on the converter wall according to the method of the present invention.
Figure 2:
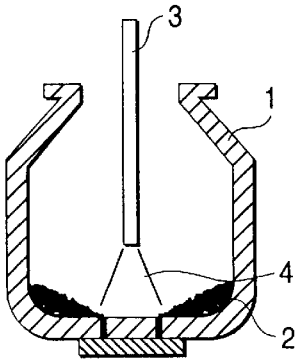
FIGS. 2(*a*), 2(*b*), and 2(*c*) are schematic diagrams illustrating occurrences inside the converter during each step in the process shown in FIG. 1.
Figure 2:
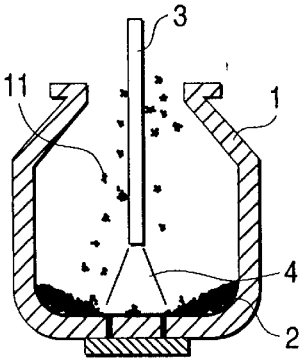
Figure 2:
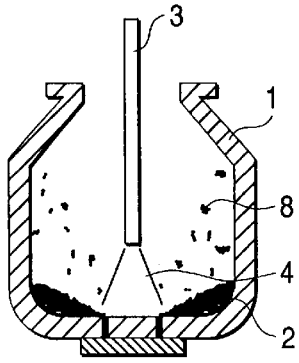

According to the present invention, slag coating on the converter wall may be carried out as illustrated in FIGS. 1 and 2. In FIG. 1, there are shown a top-blown converter 1, a lance 3 for inert gas installed in the converter 1, a chute 6 for slag solidifier and reducing agent, a trunnion axis 7 on which the converter 1 is movably supported, a trunnion side 5, bottom-blown nozzles 10, remaining slag 2 in the converter 1, a gas 4 being blown into the converter 1, slag 8 being splashed toward the converter wall by the gas 4 blown from the lance 3, and a slag coating layer 9 formed by the splashed slag 8. The trunnion side 5 includes the barrel of the converter wall, which is including the throat 5' of the converter 1, to which the trunnion axis 7 is attached.

According to the method of the present invention, slag coating is accomplished as follows. First, the converter is tilted for tapping in such a way that an adequate amount (part or all) of slag 2 remains at the bottom of the converter 1, as shown in FIG. 1 and FIG. 2(*a*). The lance 3 is lowered and fixed in the converter 1 at a carefully controlled distance above the converter bottom 12. Jets of the gas 4 from the lance 3 are directed toward the slag 2 at a carefully controlled flow rate. Simultaneously, the slag solidifier 11 (such as dolomite) is added to the slag 2 through the chute 6, as shown in FIG. 1 and FIG. 2(*b*), so that the slag 2 contains solid phase in a carefully controlled ratio. In this way, the slag 2, with an important ratio of solid phase is splashed. The splashed slag 8 sticks to the wall of the converter, particularly the trunnion side 5 heretofore difficult to repair, forming the slag coating layer 9, as shown in FIG. 1 and FIG. 2(*c*).

The slag coating method according to the present invention is characterized by critically controlling the height of the lance 3 from the bottom of the converter, the flow rate of inert gas flowing through the lance 3 and the ratio of solid phase in the slag 2 which varies depending on the amount of the slag solidifier 11, introduced alone or in combination with a reducing agent. In other words, the lance height should be about 0.7 m, preferably in the range of about 1.0–3.0 m, the gas flow rate should be in the range of about 250–600 $Nm^3$/min, and the ratio of solid phase in the slag should be in the range of about 0.5–0.7. These factors affect the height to which the slag 2 is splashed, and the ability of the splashed slag to stick to the wall of the converter.

The lance used in the method of the present invention is not specifically restricted so long as it realizes a gas flow rate within the above-mentioned range and it moves to a position within the above-mentioned range. An adequate gas flow rate is important for the slag 2 with a prescribed ratio of solid phase to be splashed to that part of the converter wall that needs repair. The lance height should be adjusted according to the properties of the slag 2 in the converter 1. It is possible to install a special lance that meets special conditions for slag coating, however, an ordinary blowing lance (as shown in FIG. 1) for the top-bottom-blown or top-blown converter will suffice.

The converter 1 to which the method of the present invention is applied is not specifically restricted. However, it should preferably be a top-bottom-blown or top-blown converter as shown in FIGS. 1 and 2, because they are equipped with a blowing lance that can be used as the lance 3 for slag coating. Incidentally, in the case where the gas blowing lance 3 for slag coating is separately installed, the method of the present invention can be applied to the top-blown or top-bottom-blown converter as well as the bottom-blown converter. When the method of the present invention is applied to the top-bottom-blown or bottom-blown converter, which has the blowing nozzles at the bottom, it is necessary to apply gas pressure to the bottom nozzles in order to protect them from the top-blown gas.

According to the method of the present invention, the lance height should be in the range of about 0.7–3.0 m, preferably about 1.0–2.9 m, and more preferably about 1.8–2.8 m. The reason for this is given below, with reference to FIG. 4.

Figure 4:
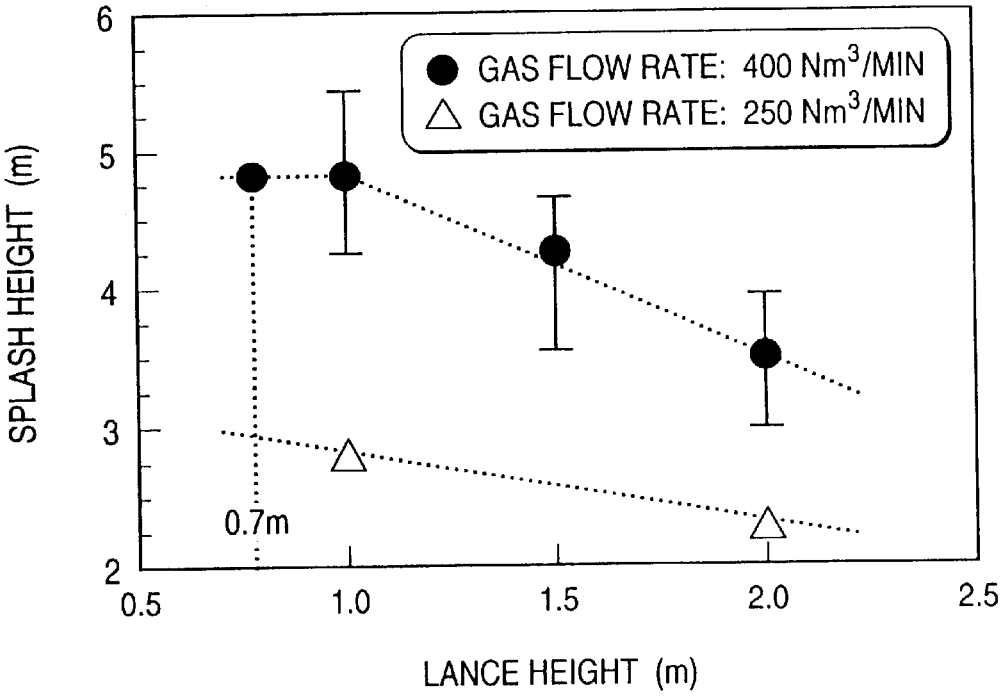
FIG. 4 is a graph showing the relationship between the lance height and the splash height, with the gas flow rate kept at two levels, in an example of the present invention.

FIG. 4 shows a relationship between lance height and splash height, which is the distance from the converter bottom to the point the splashed slag reaches. In FIG. 4 the gas flow rate is tested at 400 and 250 $Nm^3$/min. It is noted that the splash height increases when the gas flow rate is higher or when the lance height from the bottom decreases. This indicates that a greater gas flow rate and a smaller lance height are desirable. However, a minimum lance height of about 0.7 m should be provided to prevent a possible collision of the lance with the bottom of the converter.

Figure 5:
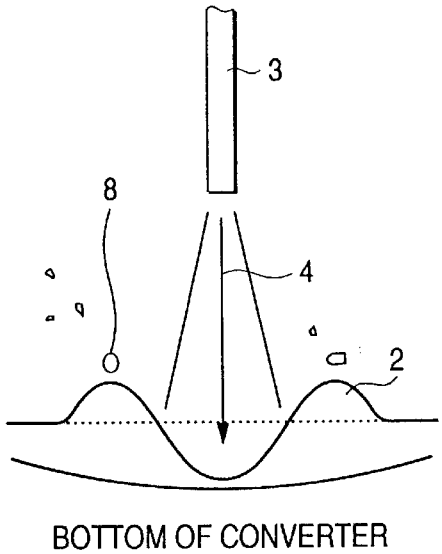
FIGS. 5(*a*) and 5(*b*) are schematic diagrams illustrating how remaining slag is splashed differently depending on the lance heights higher or lower than 1 meter.
Figure 5:
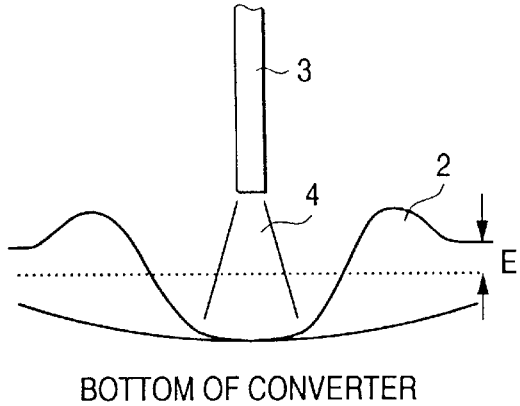

FIG. 5(*a*) illustrates schematically how slag is caused to be splashed by the method of the present invention. A gas blown from the lance depresses the remaining slag, producing a crest of slag that surrounds the depression. This slag crest initiates and becomes the splashes. As the lance is brought closer to the remaining slag as shown in FIG. 5(*b*), the depression of the remaining slag becomes larger, decreasing the efficiency of producing splashed slag by the blown gas. A probable reason for this is that the remaining slag 2, pushed sideward by the blown inert gas 4, gains potential energy (E) but the splashed slag 8 loses kinetic energy accordingly, decreasing the splash height.

It is believed that this phenomenon takes place in the region shown in FIG. 4 as the lance height changes from 0.7 m to 1.0 m, with the gas flow rate kept at 400 $Nm^3$/min. In this region, there is no change in splash height. Thus, the lance height should preferably be about 1 m for the same gas flow rate, from the standpoint of efficiency in producing splashed slag.

The splash heights shown in FIG. 4 are the heights reached by clay-like splashed slag. That height was 4.8 m when the gas flow rate was 400 $Nm^3$/min and the lance height was 0.7 m. It was as high as about 7 m in the case of slag having a high ratio of solid phase immediately after the addition of slag solidifier.

The splash height can be increased by increasing the gas flow rate. Incidentally, the minimum lance height may be increased to 1.8 m in order to prevent the lance from accidentally coming, into contact with molten slag, because there may be an instance where the surface of molten slag is 1.8 m high immediately after tapping.

If the lance height is greater than about 3.0 m, it is impossible to efficiently produce the splashed slag 8 from the remaining slag 2. If it is produced anyhow, the splashed slag 8 will not fly as high as desired and hence will not stick to that part of the converter wall that needs repair.

The lance height may be kept constant throughout the process, or may be varied time to time.

According to the method of the present invention, the gas flow rate should be within the range of about 250–600 $Nm^3$/min, preferably about 300–500 $Nm^3$/min, and more preferably about 350–450 $Nm^3$/min. The reason for this is as follows. With a gas flow rate smaller than about 250 $Nm^3$/min, the blown gas will not splash the remaining slag 2 to the desired height and hence will not stick the splashed slag 8 to that part of the converter wall, particularly the barrel at the trunnion side that needs repair. Conversely, with a gas flow rate larger than about 600 $Nm^3$/min, the blown gas splashes the remaining slag 2 too high, causing the splashed slag 8 to form an extraordinarily thick coating layer at the throat of the converter. Another problem is that the splashed slag sticks to the skirt and hood of the converter.

The gas flow rate should be adjusted according to the height of the repair part so as to save on utility cost. For example, it should be reduced to about 250 $Nm^3$/min if the repair part is lower than about 3 m from the bottom, and it should be increased to about 600 $Nm^3$/min if the repair part is higher than about 7 m from the bottom, as in the throat. The gas flow rate may be kept constant throughout the process, or may be varied from time to time.

According to the method of the present invention, the angle of the lance 3 at the time of inert gas blowing is not specifically restricted so long as the blown gas splashes the slag to the desired height. The angle of the lance 3 should be such that the jet of the gas 4 blown from the lance 3 causes the splashed slag 8 to fly furthest.

The number of lances 3 is not specifically restricted so long as the desired gas flow rate is achieved in the above-mentioned range. There maybe one or more.

The gas 4 used in the method of the present invention is not specifically restricted; however, an inexpensive gas is desirable, such as nitrogen, argon, air, or a mixture thereof. Since the blowing lance for the converter is designed to blow pure oxygen as well as nitrogen and argon, it is desirable to use an inert gas, such as nitrogen and argon, which does not need the lance to be modified.

According to the method of the present invention, the slag should have an adequate ratio of solid phase content, which is in the range of about 0.5–0.7, preferably about 0.55–0.68, and more preferably about 0.60–0.65. With a ratio of solid phase lower than about 0.5, due to insufficient slag solidifier 11, the slag 2 has so low a viscosity and so high a fluidity as to form the splashed slag 8. The splashed slag 8, even though formed, is too small in particle size to fly, and the slag in the form of fine particles will drop off or flow down soon after contacting the converter wall. Conversely, with a ratio of solid phase higher than 0.7 (due to excess slag solidifier 11), the slag 2 has such a high viscosity that the splashed slag 8 is too hard to stick to the wall when it reaches the wall. In addition, such splashed slag 8 is in the form of coarse particles which do not fly to the repair part, or the viscous slag 2 cannot be made into the splashed slag 8.

According to the present invention, the ratio of solid phase in the slag is defined as the weight of solid phase divided by the weight of solid phase plus liquid phase.

According to the present invention, the ratio of solid phase in the slag is calculated from the weight of the remaining slag 2 and the weight of the slag solidifier by using a program for thermodynamics (such as Chem Sage computer program). This program needs as inputs the temperature of the slag 2 and the amount of each component (such as CaO and $SiO_2$) in the solidifier added. With such data entered, the program calculates the weight of liquid phase and solid phase (simple substance or compound) of each component which minimizes the standard free energy of the system. Table 1 shows an example of such calculations.

The thus calculated ratio of solid phase in the slag is utilized to control the ratio of solid phase in the desired range as mentioned above. The ratio of solid phase may be controlled for each run by the above-mentioned calculations. Alternatively, it may be controlled by the amount of slag solidifier to be added which has been previously calculated under different conditions. Moreover, the variation in the ratio of solid phase due to errors in measurements or calculations may be corrected by supplementing the slag solidifier while monitoring the splashing of slag that occurs about 0–2 minutes after the start of gas blowing.

The remaining slag 2 is combined with a slag solidifier 11 so that the resulting slag has a ratio of solid phase in the range of about 0.5–0.7 as mentioned above. This slag solidifier is not specifically restricted so long as it contains MgO or CaO. Any known slag modifier can be used. Examples of the MgO-containing slag solidifier include light burnt dolomite and dried dolomite and a mixture thereof. Examples of the CaO-containing slag solidifier include calcined lime and limestone. These two kinds of slag solidifiers, each containing MgO or CaO, may be used in combination.

The slag solidifier 11 may be added to the remaining slag 2 in the converter 1 at any time after the blowing of inert gas 4 from the lance 3 has been started. The adequate timing is about zero to two minutes after the start of blowing, because the jet of inert gas 4 from the lance 3 is necessary for the slag solidifier 11 to be mixed with the slag 2.

The slag solidifier 11 may be added in any manner. That is, it may be added continuously or intermittently at a constant rate or a varied rate per unit time. The rate of addition should preferably be about 0.7–0.9 t/min, although it is not restricted. More than one kind of slag solidifier 11 may be added—all together or individually, continuously or intermittently.

The slag solidifier 11 may be admitted into the converter 1 directly through the chute 6 or together with the inert gas 4 through the lance 3. It should be admitted in such a way that it is uniformly mixed with the remaining slag 2.

The slag solidifier 11 added to the remaining slag 2 as mentioned above is stirred and mixed by the inert gas 4 blown from the lance 3.

There is an instance where a slag 2 of a certain composition does not give the desired ratio of solid phase when it is combined with the slag solidifier. It was found that the desired ratio of solid phase can be achieved in such a case by adding a reducing agent. The effect of a reducing agent was studied as follows.

Slag 2 remaining in an adequate amount in the converter 1 was stirred by blowing an inert gas 4 at a flow rate of 400–600 $Nm^3$/min from the top-blown lance 3 positioned 1.8–2.8 m above the bottom so that the gas jet splashes the remaining slag most effectively. While being stirred, the slag 2 was examined for the percent T.Fe concentration.

It was found that different steps are necessary depending on the value of T.Fe so as to achieve the ratio of solid phase within the above-mentioned range about 0.5–0.7. That is, if T.Fe<15%, then no slag solidifier is required.

In the case of 15%≦T.Fe<22%, a slag solidifier is required. Light burnt dolomite and dried dolomite should be added in an mount of 10–15 wt % of the remaining slag if the desired ratio of solid phase is 0.60–0.65. If T.Fe≧22%, then the slag solidifier should be added in combination with a reducing agent, such as graphite or coke. The value of T.Fe (%) is conveniently determined by fluorescent X-ray analysis. It represents the oxygen potential in the slag. In actual operation, the T.Fe (%) is estimated from the oxygen concentration in the steel, or the oxygen concentration in the steel at the time of blowing-out, and is regarded as the T.Fe (%) value. It is considered that an equilibrium is reached between the oxygen concentration in the steel and the T.Fe (%) in the slag after blowing-out, because the analysis of T.Fe (%) takes about 10 minutes.

The oxygen concentration in the steel is determined without timelag during operation by means of a sublance.

According to the present invention, a reducing agent is added when the slag 2 contains more than about 22% of T.Fe. If an MgO-based solidifier is added alone to increase the ratio of the solid phase, the amount of MgO exceeds the limit just enough to protect the refractories when the coated layer is melted by blowing during a subsequent run. The result is poor metallurgical characteristics, particularly phosphor distribution ratio and inadequate dephosphorization. The reducing agent to be added is not specifically restricted. It includes, for example, graphite and/or coke as mentioned above.

Figure 3:
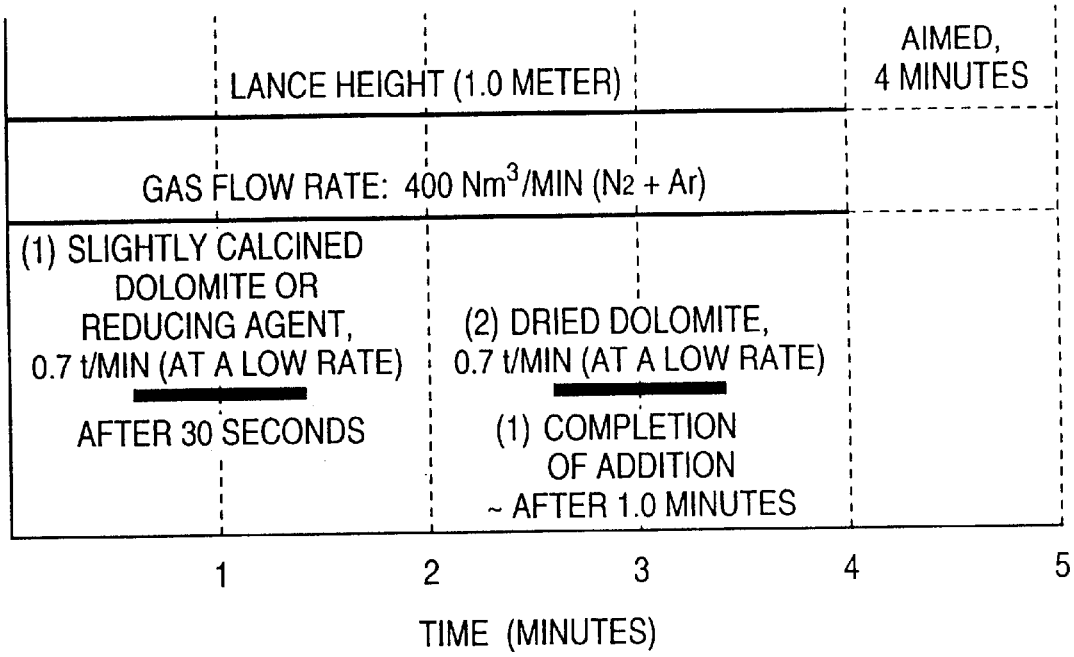
FIG. 3 is a time chart illustrating one example of the operating pattern in carrying out the method of the present invention.

FIG. 3 shows a sequence of steps for slag coating carried out under the following conditions according to the method of the present invention.

Lance height: 1 m

Gas flow rate: 400 $Nm^3$/min (140 $Nm^3$/min for $N_2$ plus 260 $Nm^3$/min for Ar) Slag solidifier added first: light burnt dolomite (500 kg) alone (or in combination with graphite or coke (100 kg) as a reducing agent if T.Fe≧22%), at a low rate of 0.7 t/min, 30 seconds after the start of blowing from the lance. See FIG. 2(*b*). Slag solidifier added second: dried dolomite (500 kg) at a low rate of 0.7 t/min, one minute after the completion of the first addition of the solidifier or reducing agent. See FIG. 2(*b*). The blowing of the inert gas 4 from the lance 3 was continued for 4 minutes, so that a slag coating 9 with a desired thickness was formed. The entire process took 4 minutes to complete the slag coating. The length of the process may be extended to 5 minutes depending on the thickness of the slag coating 9.

In the case mentioned above, where the amount of remaining slag was 5–7 tons in the 180-ton converter, the length of the entire operating time was 4–5 minutes. The length of time may be adequately varied depending on the converter size, the thickness of slag coating, the lance height, the gas flow rate, and the ratio of solid phase in slag.

As mentioned above, the method of the present invention for slag coating on the converter wall causes slag to splash toward the converter wall such that splashed slag sticks to the wall and forms a uniform coating layer thereon. Therefore, slag coating in this manner repaired that part of the converter wall which was 4–5 meters high from the bottom and was subjected most to corrosion. The result is a beneficially extended converter life, without the refractories wearing out unevenly at a hard-to-repair part.

The slag coating according to the present invention will be described in more detail with reference to the following examples.

EXAMPLE 1

This example demonstrates the method of the present invention which was applied to a top-blown converter 1 as shown in FIG. 1.

A 180-ton top-bottom-blown converter 1 was run in such a way that 5–7 tons of slag 2 remained after tapping. With the end of the lance 3 positioned 1.8 meters above the bottom, nitrogen was blown toward the slag 2 at a flow rate of 400 $Nm^3$/min. It was found that the remaining slag as such had such a high ratio of liquid phase that the jet of inert gas 4 just waved the slag surface vigorously without forming slag splash 8.

Thirty seconds after the start of gas blowing, the remaining slag was incorporated with light burnt dolomite (500 kg) as a solidifier 11 to supply MgO. As the slag 2 increased in MgO content and viscosity, slag splash 8 began to occur. However, the slag splash 8 at this stage was small in particle diameter and did not stick firmly to the converter wall, because the ratio of solid phase in the slag had not yet reached the value of 0.6 intended in this example. Two and a half minutes after the start of gas blowing, the slag was combined with dried dolomite (500 kg) as a solidifier 11, which is superior in cooling capacity to the light burnt dolomite added first. The slag 2 decreased in temperature and increased in the ratio of solid phase to a value higher than 0.6. With further blowing it splashed in the form of large particles like sherbet and the slag splash covered the coating layer 9 which had been formed previously after incorporation with the first solidifier.

In this way it was possible to form an almost uniform slag coating layer 9 on the entire wall surface of the barrel of the converter 1.

The procedure in this example was carried out by using the existing blowing lance for the converter. The top-bottom-blown converter used in this example had the bottom-blown nozzles 10 at its bottom. During operation in this example, a gas pressure was applied also to the bottom-blown nozzles 11 for their protection from any damage by the top-blown gas.

The procedure mentioned above was repeated, with the gas flow rate, the lance height, and the amount of solidifier expressed as the ratio of solid phase individually varied, and their effect on slag coating characteristics, such as layer thickness and splash height, was investigated.

Figure 6:
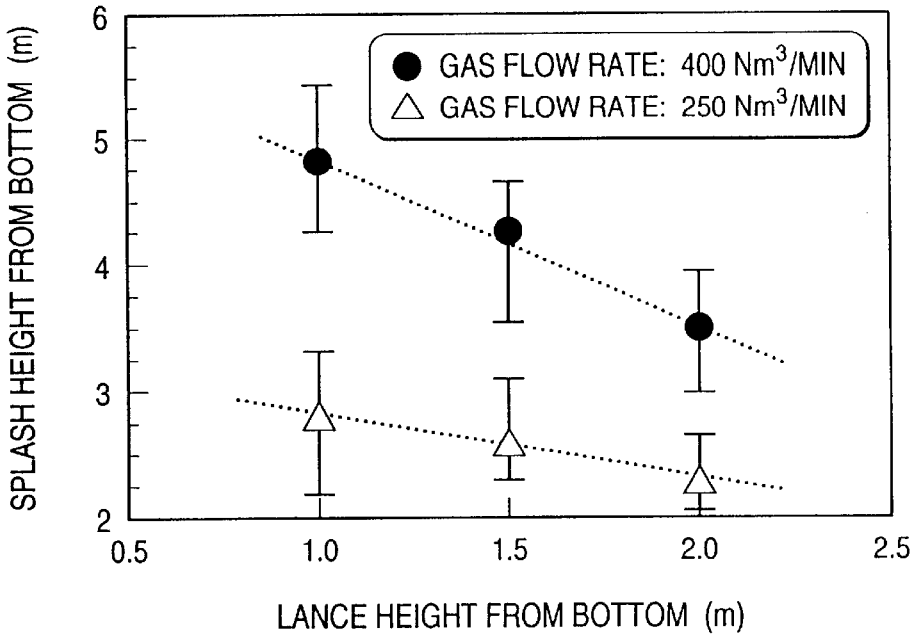
FIG. 6 is a graph showing the relationship between the lance height and the splash height, with the gas flow rate kept at two levels, in an example of the present invention.

FIG. 6 shows how the splash height is affected by the lance height at different gas flow rates. It is noted that the splash height increases as the gas flow rate increased, within the range of 250–600 $Nm^3$/min and the lance height decreased within the range of 1.0–3.0 meters. This factually means that the gas flow rate and the lance height should be critically controlled according to the height of the part that needs repair. Even though the lance height was reduced to 0.8 meters, with the gas flow rate kept at 400 $Nm^3$/min, the splash height remained the same as when the lance height was 1 meter. The reason for this is furnished from the explanation given above in connection with the necessary range of the lance height.

Figure 7:
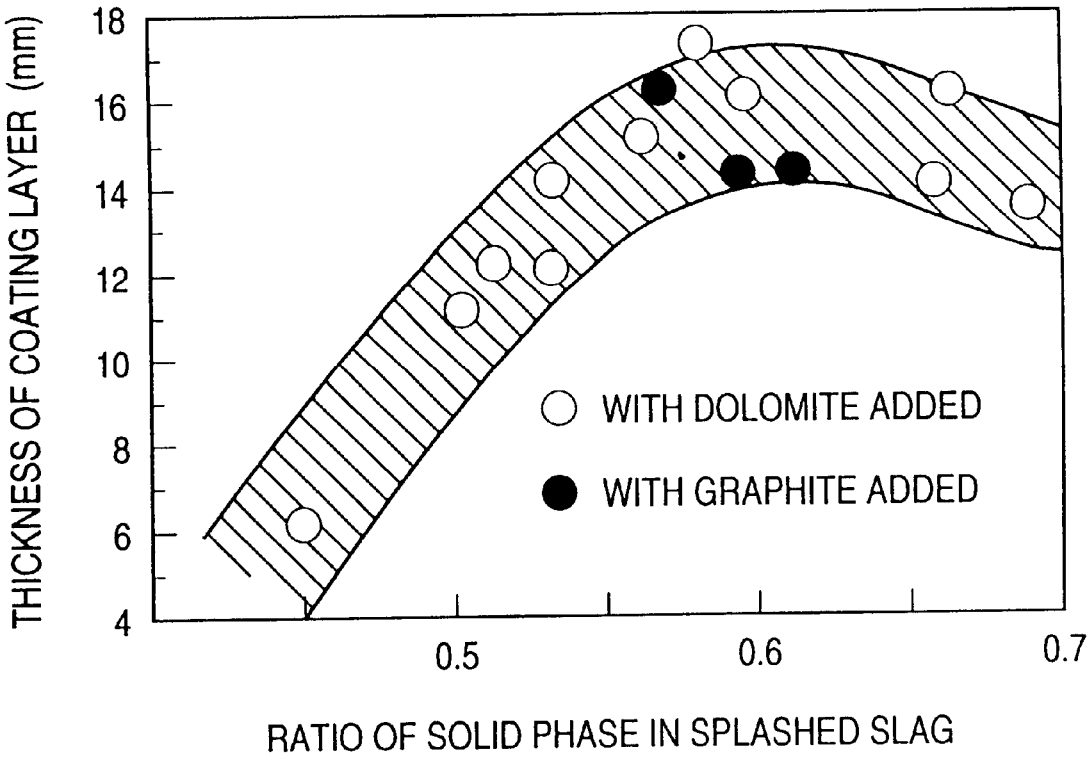
FIG. 7 is a graph showing how the ratio of solid phase in the slag affects the thickness of the coating layer in an example of the present invention.

The procedure mentioned above was repeated for variation of coating thickness depending on the amount of solidifier added, hence the ratio of solid phase, with the lance height and the gas flow rate kept constant. The results are shown in FIG. 7. It is noted that the coating thickness was found to be maximum when the ratio of solid phase in the slag was 0.6 and that the coating thickness varied from about 8 mm to 17 mm when the ratio of solid phase ranged from 0.5 to 0.7.

To control the ratio of solid phase to 0.6 as desired, it was necessary to add 500 kg each of light burnt dolomite and dried dolomite in the case of $15\% \leqq T.Fe \leqq 22\%$. It was necessary to add 500 kg each of light burnt dolomite and dried dolomite and 100 kg of graphite as a reducing agent in the case of $T.Fe \geqq 22\%$.

Figure 8:
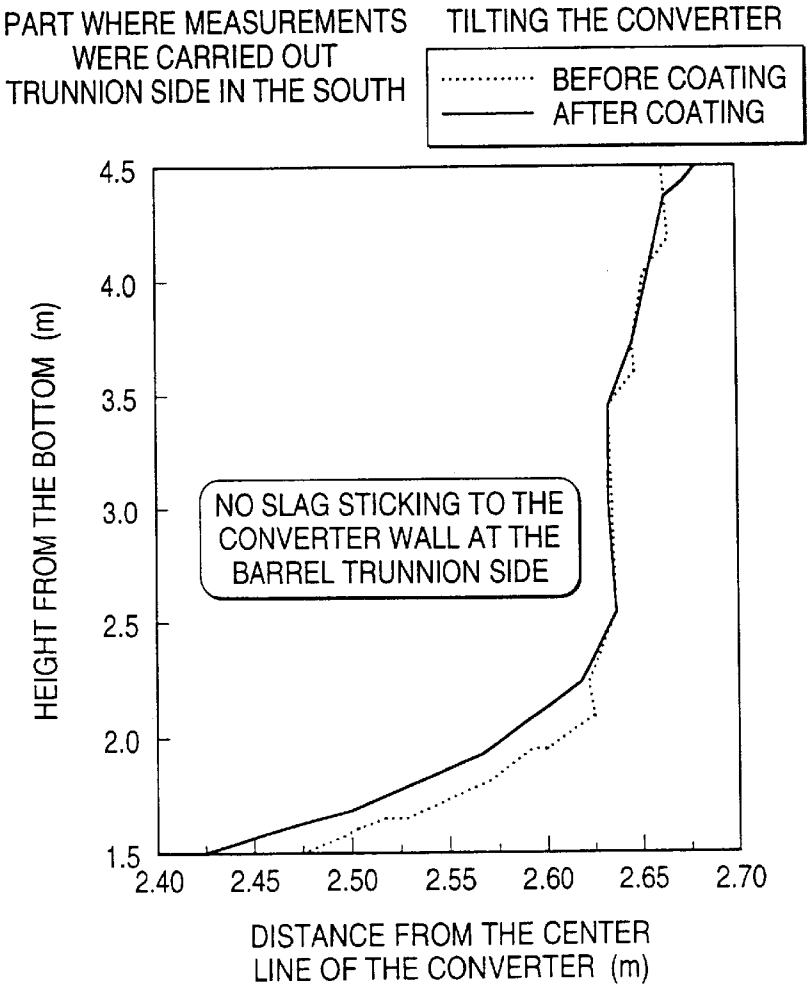
FIGS. 8(*a*) and 8(*b*) are graphs illustrating the results of examples according to the conventional method and the method of the present invention.
Figure 8:
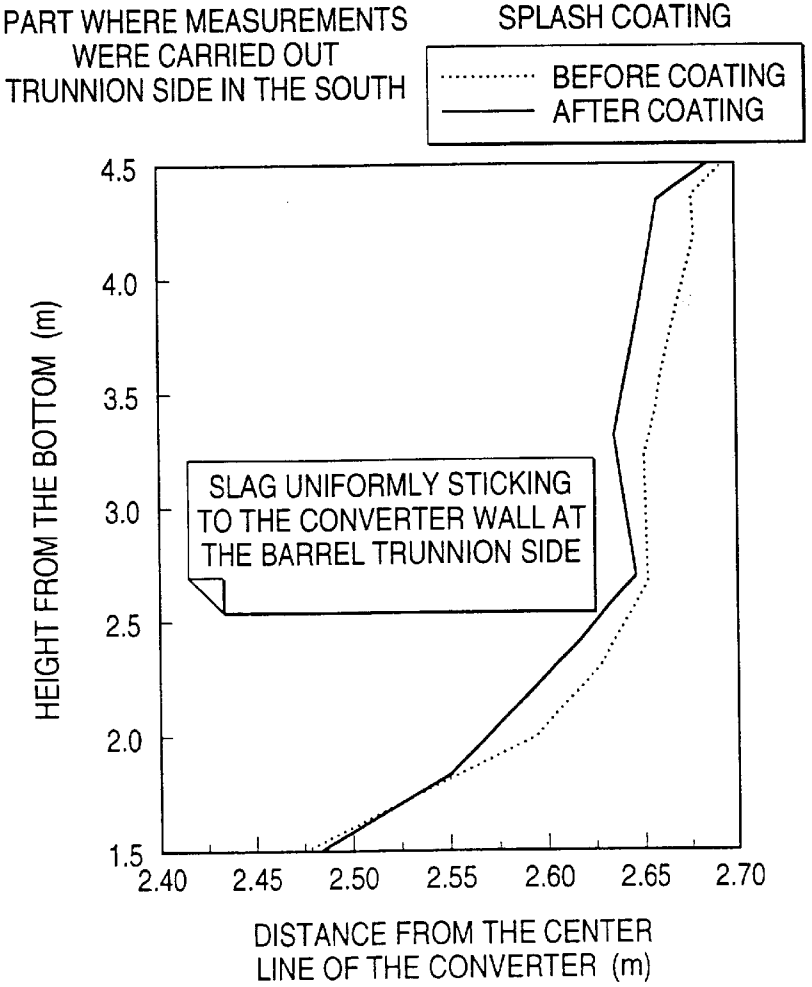

The thickness of refractories in the converter was measured with a laser profile meter before and after slag coating by the conventional tilting method as compared to the method of the present invention. The results are shown in FIGS. 8(*a*) and 8(*b*). It is noted from FIG. 8(*a*) that slag did not even stick to the wall at the trunnion side when the converter was tilted. On the other hand, it is apparent from FIG. 8(*b*) that a coating layer with an average thickness of 20 mm was formed over the trunnion side 3–4 meters above the bottom when the method of the present invention was used. In addition, it was found that this coating layer remained (5–10 mm thick) even after the next tapping.

Figure 9:
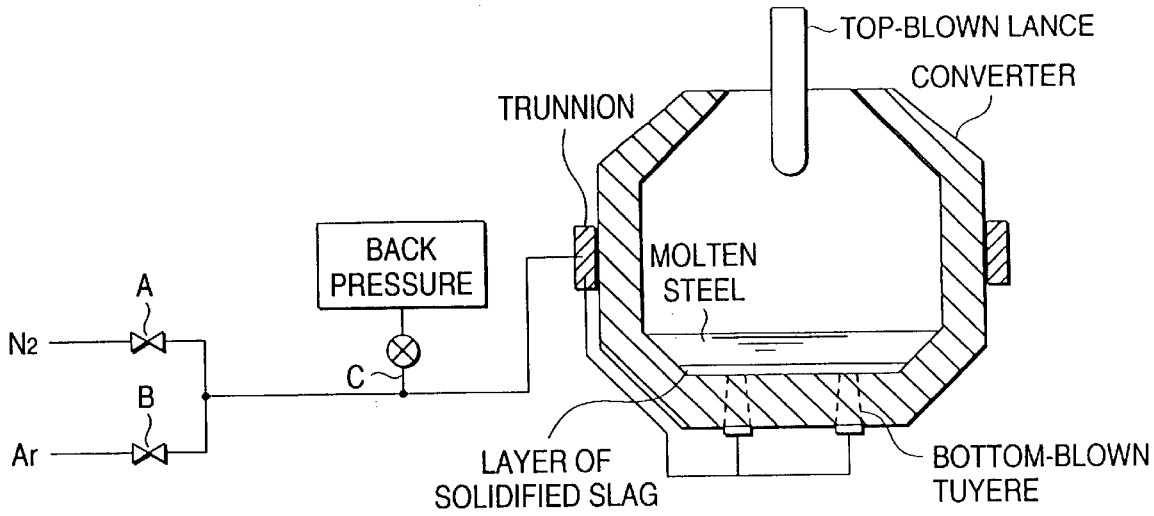
FIG. 9 is a schematic diagram showing the method of detecting the back pressure of the tuyere.

Now, an explanation is given below of the method of controlling the bottom thickness of the converter at the time of slag coating. Repeated slag coating on the converter wall may increase the thickness of the converter bottom due to accumulation of solidified slag. Solidified slag is formed when an inert gas is blown toward slag from the top-blown lance. This phenomenon may occur when slag coating is carried out with the ratio of solid phase kept high. The thickened bottom prevents the uniform passage of gas through the tuyere, resulting in the molten steel being stirred unevenly. This is a serious hindrance to the normal operation of the converter. To cope with this situation, the present invention provides a method of controlling the bottom thickness of the converter. This method comprises detecting the back pressure of a gas being forced into the converter through the bottom-blown tuyere and determining the increase of thickness of the bottom of the converter from increase of back pressure at the tuyere. This method will be described with reference to FIG. 9.

The bottom-blown tuyere of the converter was supplied with an inert gas such as nitrogen and/or argon through the trunnion, and the inert gas was blown into the molten steel through the bottom-blown tuyere.

Figure 10:
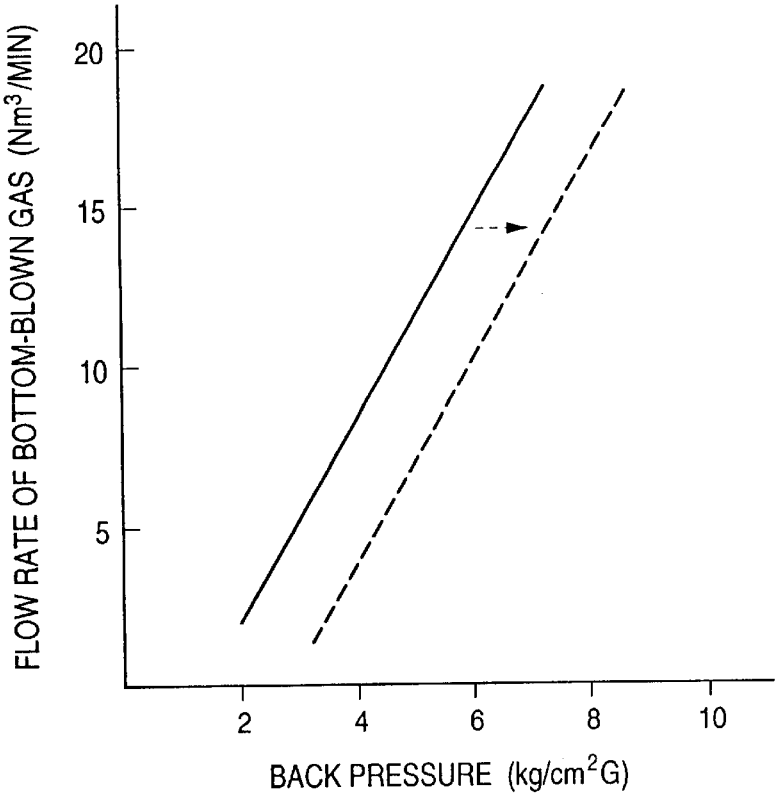
FIG. 10 is a graph showing how the back pressure of the tuyere changes according as the bottom thickness increases.

The feed lines for nitrogen and argon were provided with valves A and B, respectively. The amount of gas to be supplied to the tuyere is adjusted by these valves. The back pressure of the tuyere is detected by the pressure gage attached to the feed line. Assuming that the pressure loss in the gas feed line remains constant, the pressure detected by the pressure gage will vary according as the layer of solidified slag changes in thickness. Thus, any increase in the thickness of the bottom layer can be detected by measuring the back pressure of the tuyere. FIG. 10 shows the relation between the back pressure of the bottom-blown tuyere and the flow rate of the gas passing through the gas feed line. The solid line represents the normal relation. It moves rightward as indicated by the dotted line when the bottom thickness increases. This change can be detected easily.

After the bottom thickness has increased, it is possible to restore the original thickness or reduce the thickness by providing the bottom of the converter after tapping with an alumina source to reduce the melting point of the slag. Then, the slag is stirred by blowing a gas through the bottom-blown tuyere and/or top-blown lance, so that the solidified slag of the thickened layer is melted again and the thickness of the bottom layer is reduced. This procedure may be repeated several times until the solidified slag is melted as much as desired.

The alumina source may be aluminum ash or slag from continuous casting or ladling containing 20–25% alumina.

The above-mentioned explanation may also be applied to the converter which is equipped with a tuyere for oxygen blowing in place of inert gas blowing.

The following example is given to explain the method of controlling the bottom thickness of the converter according to the present invention.

EXAMPLE 2

One month after continued operation with repeated slag coating, the converter began to increase in back pressure of the tuyere. When the increase in back pressure recorded about 20%, the converter was tilted after tapping while leaving 6 tons of slag. The remaining slag was combined with 3.2 tons of the slag from continuous casting, and the product was stirred and controlled by increasing the amount of gas supplied to the bottom-blown tuyere. At this stirring, the slag contained about 10% alumina, decreasing the slag melting point as hereto disclosed. The tilting of the converted and the blowing of gas from the tuyere were repeated for about 10 minutes. Then the slag was discharged. The converter was charged with 180 tons of molten iron and was operated in the usual way. During operation, the back pressure of the tuyere decreased, indicating that the bottom thickness had decreased because the solidified slag layer had melted again. The reason why the slag was discharged is that the slag having a decreased melting point severely wears the converter wall at the slag line.

We have described this invention in its preferred form. Many modifications and variations of the present invention may be made, without departing from the spirit and scope thereof.

TABLE 1

Amount of slag (to be used for coating) remaining in the converter: 5 tons
Solidifier: slightly calcined dolomite 500 kg/ch (CaO; 57.2%, MgO; 38.7%)
Solidifier: green dolomite 500 kg/ch (CaO; 34.9%, MgO; 17.3%)
Amount of slag in the converter = 5000 + 500 + 500 = 6000 kg
Composition of slag remaining in the converter (%)

| T.Fe | CaO | $SiO_2$ | MnO | $Al_2O_3$ | MgO | $P_2O_5$ |
|---|---|---|---|---|---|---|
| 18.2 | 45.5 | 11.3 | 4.5 | 5.0 | 7.0 | 1.39 |
| 16.5 | 45.6 | 10.3 | 4.1 | 4.5 | 8.9 | 1.26 |

Ratio of solid phase = 2952.1/5756.7 = 0.51

T = 1200.00 C
P = 1.00000E + 00 bar
V = 0.0000E + 00 $dm^3$

Assuming that FeO accounts for 100% in T.Fe

| REACTANTS: | AMOUNT/kg | |
|---|---|---|
| FeO | 1277.1 | ← FeO(Kg) = 6000 × 0.165 × 1.29 = 1277.1 (kg) |
| CaO | 2736.0 | ← CaO(kg) = 6000 × 0.456 = 2736 (kg) |
| $SiO_2$ | 618.0 | ← $SiO_2$(kg) = 6000 × 0.103 = 618 (kg) |
| MnO | 246.0 | ← MnO(kg) = 6000 × 0.041 = 246 (kg) |
| $Al_2O_3$ | 270.0 | ← $Al_2O_3$(kg) = 6000 × 0.045 = 270 (kg) |
| MgO | 534.0 | ← MgO(kg) = 6000 × 0.089 = 534 (kg) |
| $P_2O_5$ | 75.6 | ← $P_2O_5$(kg) = 6000 × 0.0126 = 75.6 (kg) |

↑ Items for input TOTAL 5756.7

| PHASE:SLAG | kg | | EQUIL AMOUNT WEIGHT FRACTION | ACTIVITY |
|---|---|---|---|---|
| $Sio_2$ | 49.6 | ← Weight of liquid phase for each composition | 0.018 | 4.26E − 06 |
| $Al_2O_3$ | 270.0 | | 0.096 | 4.77E − 05 |
| $P_2O_5$ | 65.8 | | 0.023 | 5.82E − 24 |
| CaO | 847.6 | | 0.302 | 4.23E − 02 |
| FeO | 1277.1 | | 0.455 | 4.78E − 01 |
| MgO | 48.5 | | 0.017 | 3.65E − 02 |
| MnO | 246.0 | | 0.088 | 1.13E − 01 |
| TOTAL | 2804.6 | | 1.00E + 00 | 1.00E + 00 |

↑ Total weight of liquid phase

TABLE 1-continued

| | Kg | | ACTIVITY |
|---|---|---|---|
| 3Cao, $SiO_2$ | 2160.2 | | 1.00E + 00 |
| MgO | 485.5 | ← Weight of each | 1.00E + 00 |
| CaO | 281.1 | compound (solid phase) | 1.00E + 00 |
| 4CaO, $P_2O_5$ | 25.3 | TOTAL | 1.00E + 00 |
| FeO | 0.0 | 2952.1 | 5.66E − 01 |
| . | . | | . |
| . | . | | . |
| . | . | | . |

What is claimed is:

1. A method of coating slag on at least a portion of a converter having a bottom and a barrel with trunnion sides which needs repair comprising the steps of:

causing at least some of molten slag produced in the converter to remain on the bottom of the converter after tapping, downwardly blowing a gas from a top-blown lance, thereby splashing said molten slag, controlling the lance height as measured, from the converter bottom, to an outlet of said lance, to about 0.7–2.9 m while controlling the gas flow rate to about 250–600 $Nm^3$/min, combining, after the start of said gas blowing, remaining molten slag with a slag solidifier comprising an oxide selected from the group consisting of MgO and CaO, wherein said slag solidifier is controlled to provide a ratio of solid phase in said slag to about 0.50–0.70, controlling the height of said slag splashing and amount of slag sticking to said converter wall, and splashing said molten slag onto said barrel to uniformly and stably cover the entire trunnion sides.

2. The method of slag coating defined in claim 1, wherein said lance height is about 0.7–2.0 m.

3. The method of slag coating as defined in claim 1 or 2, wherein the remaining slag in said converter is combined with said slag solidifier about 2 minutes or less after the start of said gas blowing.

4. The method of slag coating defined in claim 1, wherein said slag solidifier is added in combination with a reducing agent so that the ratio of solid phase in said slag is about 0.50–0.70 in the case where the oxygen potential in said slag is about 22% or higher total slag iron content (T.Fe).

5. The method as defined in claim 1, wherein the gas used for slag splashing is selected from the group consisting of nitrogen, argon, a mixture thereof, air, and a mixture of air and nitrogen, a mixture of air and argon, and a mixture of air, argon and nitrogen.

6. The method as defined in claim 1, wherein said gas flow rate is about 250 $Nm^3$/min when said part to be repaired is lower than about 3 meters from the bottom of said converter, and wherein said gas flow rate is about 600 $Nm^3$/min when said part to be repaired is higher than about 7 meters from the bottom of said converter, and wherein the gas flow rate is adjusted to save utility cost according to the position of the part to be repaired.

7. The method defined in claim 1, wherein in operating the converter for carrying out said coating with slag, said method comprises further steps of introducing a gas into said converter through a bottom-blown tuyere, detecting the back pressure of said gas forced into said converter through said bottom-blown tuyere, and determining an increase in the thickness of the bottom of said converter from an increase of said back pressure at said tuyere.

8. The method defined in claim 7, including the further step of introducing a solvent agent into said molten slag remaining at the bottom of said converter after tapping, in an amount to decrease the melting point of said slag, and stirring said slag with gas introduced into said converter.

9. The method defined in claim 8, wherein said gas is introduced through a top-blown lance or a bottom-blown tuyere.

10. The method defined in claim 8, wherein said solvent agent is an alumina source.

11. The method of slag coating defined in claim 1, wherein said lance height is about 1.0–2.0 m.

* * * * *